US005431796A

United States Patent [19]

Latella

[11] Patent Number: 5,431,796

[45] Date of Patent: Jul. 11, 1995

[54] SHORTCIRCUITING SYSTEM FOR USE IN MONOPOLAR AND BIPOLAR ELECTROLYZERS

[75] Inventor: Aureli Latella, Concesio, Italy

[73] Assignee: De Nora Permelec S.p.A., Italy

[21] Appl. No.: 286,776

[22] Filed: Aug. 5, 1994

[30] Foreign Application Priority Data

Sep. 10, 1993 [IT] Italy ..... MI93A01959

[51] Int. Cl.[6] ..... C25B 9/04

[52] U.S. Cl. ..... 204/279

[58] Field of Search ..... 204/228, 279; 361/8, 361/16, 57

[56] References Cited

U.S. PATENT DOCUMENTS 4,421,614 12/1983 Yamaguchi ..... 204/98

4,618,906 10/1986 Paice et al. ..... 361/5

*Primary Examiner*—John Niebling
*Assistant Examiner*—Brendan Mee
*Attorney, Agent, or Firm*—Bierman and Muserlian

[57] ABSTRACT

A shortcircuiting system, particularly useful for by-passing an electrolyzer in a multiplicity of monopolar or bipolar electrolyzers in an electrolysis circuit, said system comprising power supply means for feeding electrolysis current to said electrolyzers, a jumper switch means for by-passing said electrolyzer and means for controlling and interrupting the electric current supplied to said electrolyzers at least for a time sufficient to permit shortcircuiting of the electrolyzer to be by-passed without significantly affecting the operating conditions of said electrolyzers.

4 Claims, 1 Drawing Sheet

SHORTCIRCUITING SYSTEM FOR USE IN MONOPOLAR AND BIPOLAR ELECTROLYZERS

BACKGROUND OF THE INVENTION

As is well-known, electrochemical plants comprise a multiplicity of electrolyzers, each one consisting in a plurality of elementary cells assembled in the so-called filter press arrangement, said elementary cells being electrically connected either in series (bipolar electrolyzers) or in parallel (monopolar electrolyzers). The electrolyzers are usually fed with a current up to 500 kA and a maximum voltage of 10 V in the case of monopolar electrolyzers, and with a current up to 20 kA and a maximum voltage of 300 Volts, in the case of bipolar electrolyzers.

In standard operating conditions, when one of the electrolyzers is to be serviced, the electrolysis current fed to the whole plant has to be interrupted to permit maintenance or substitution of the electrolyzer to be serviced.

A prolonged interruption of current to the whole plant (electrolysis circuit) causes not only a production loss but also possible damages to the internal components of the electrolyzers due to the remarkable shifts of temperature and pressure. In addition, with a prolonged interruption of current also auxiliary equipment of the plant, such as compressors, could be damaged. To avoid such a problem, the shut down as well as start-up operations require a substantial amount of time, as the current has to be respectively decreased or increased by small steps. The clear consequence of this is a further loss of production.

In conventional plants, this problem is overcome by resorting to a jumper switch means providing for by-passing the electrolyzer to be serviced in the electrical circuit of the multiplicity of electrolyzers. To avoid interruption of the electrolysis process in the remaining electrolyzers, the by-pass (disconnection) and the connection of the electrolyzer, once serviced, takes place under electric current load.

The electrolyzer to be serviced may by-passed by utilizing copper bus-bars which are connected to the terminal contacts of the electrolyzer. As the current travelling across the plant is extremely high, the operation of connecting the bus-bars involves severe dangers.

To overcome this problem, the short-circuiting bus-bars are provided with stationary contacts as well as mobile contacts, sliding over the stationary ones, which permits a full and safe operation. Further, the mobile contacts offer other advantages over the stationary ones, that is stability in the presence of vibrations, complete absorption of the thermal expansions, single contact series resistance.

The contact pressure is ensured by suitable springs, one for each mobile contact. This arrangement of bus-bars, fixed and mobile contacts, is provided by those equipments, known in the technical field as jumper switches.

However, due to the high operating current, also onto the mobile contacts arcing may take place during short-circuiting of the electrolyzers.

This problem is overcome by suitable arcing-protecting contacts which provide for anticipated closing and deferred opening with respect to the main contacts, either mobile or stationary, in order to avoid any arcing to the latter.

For switches operating with currents up to 20 kA and voltages up to 300 Volts, in addition to the arcing-protecting contacts, also a sacrificial fuse is provided.

These jumper switches, although sufficiently widespread, require a remarkable maintenance. The arcing-protecting contacts must be substituted usually every some tens of opening and closing procedures, and the sacrificial fuse after each operation. The substitution of the arcing-protecting contacts and sacrificial fuse not only is extremely expensive, but requires also the assistance of specialized maintenance personnel. Further, the risk of arcing in the contacts is not completely eliminated by the above solutions. In fact, the electric current is often decreased before proceeding to the short-circuit operation. In addition, forgetting to substitute the fuse cause serious danger during the next short-circuit operation.

OBJECTS OF THE INVENTION

It is the main object of the present invention to eliminate the inconveniences of the prior art by providing for a short-circuiting system suitable for monopolar and bipolar electrolyzers, which system permits the disconnection and the subsequent connection of said electrolyzers in a totally safe manner without interrupting the electrolysis process.

It is a further object of the present invention to provide for a short-circuiting system which eliminates the need for technical assistance and requires less maintenance than the jumper switches of the prior art. It is another object of the present invention to provide for a highly reliable short-circuiting system, of simplified construction and cost-effective with respect to the jumper switches of the prior art.

It is a further object of the present invention to provide for a short-circuiting system which utilizes also low cost jumper switches or, in the case high cost jumper switches are used, to prolong indefinitely the firing of the contacts.

The above objects, and other objects of the invention which will become evident from the following description, are achieved by the short-circuiting system of the invention for use in an electrolysis circuit comprising a multiplicity of electrolyzers, said system comprising power supply means and means for interrupting current for a very limited period of time which does not affect the operating conditions and nevertheless allows for short-circuiting of at least one electrolyzer out of said multiplicity of electrolyzers in the electrolysis circuit.

The characteristics and advantages of the present invention will be illustrated in detail in the following description of the preferred embodiments of the present invention. It is however to be understood that other embodiments of the short-circuiting system for monopolar and bipolar electrolyzers are also possible without departing from the spirit of the present invention.

The shortcircuiting system of the invention is a short-circuiting system for by-passing at least one electrolyzer (10*c*) in a multiplicity of monopolar or bipolar electrolyzers in an electrolysis circuit comprising power supply means including an electric current line (2), a rectifier (5) based on thyristors (6) and (7) and a transformer (3) for feeding electrolysis current to said electrolyzers and a control system (12) connected to an automatic current controller (13) connected in turn to a synchronism and measurement circuit (16), a jumper switch (18) with a switch (19) for by-passing said electrolyzer (10*c*), characterized in that switch (19) comprises a selector means (22) suitable for sending a start-up signal both to the control circuit (12) and to AND gate (23), connected in turn to said controller (13), a command circuit (20) connected to said gate (23) and to said jumper switch means (18) for the interruption of the electric current supplied to said electrolysis circuit for at least at time sufficient to permit shortcircuiting of said electrolyzer (10*c*) and a limit switch (21) to re-start said electric current, said interruption of electric current not affecting the operating conditions of said multiplicity of monopolar or bipolar electrolyzers.

DESCRIPTION OF THE INVENTION

Figure 1:
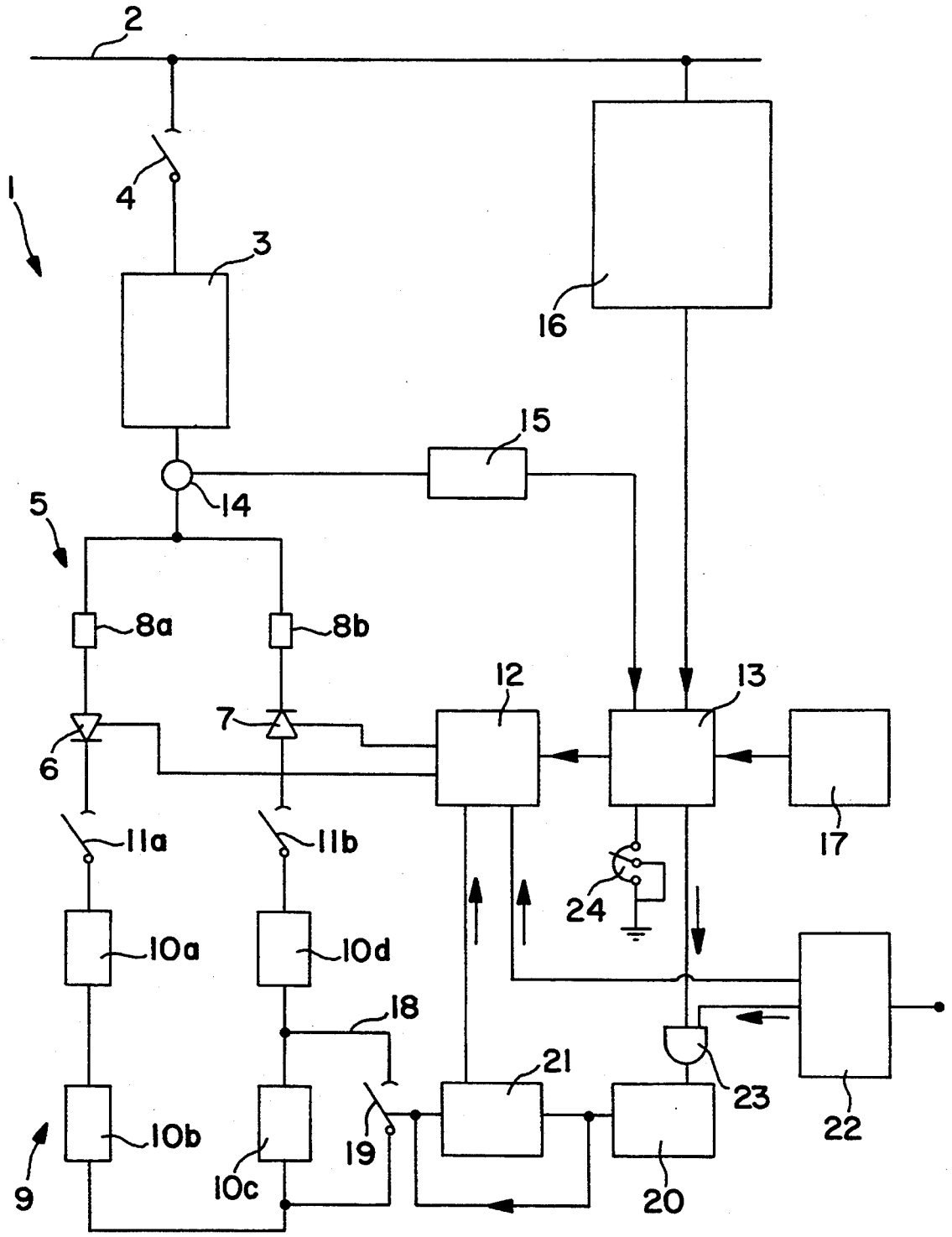
FIG. 1 is a schematic scheme of a short-circuiting system of the invention.

The invention will be now described making reference to the figure which represents an electrical block diagram wherein reference numeral 1 indicates the short-circuiting system comprising the primary three-phase electric current feed line 2 of the electrolysis plant. Line 2 is connected to a transformer 3 with a high voltage switch gear 4. The primary of transformer 3 is of the star-type connection, while the secondary is of the open-triangle-type connection. The electric circuit of the secondary is completed by rectifier 5 provided with semi-conductors, in particular thyristors.

The rectifier 5 is organized according to a Graetz bridge scheme and is indicated in a simplified form of thyristors 6 and 7. Each thyristor 6 and 7 is provided with a protection fuse 8*a* and 8*b* respectively. Transformer 3 and the rectifier 5 represent the AC/DC conversion unit. The output of rectifier 5, that is the terminals of thyristors 6 and 7 not connected to transformer 3, are connected to the electrolysis circuit comprising electrolyzers 10*a*–10*d* connected in series. Two D.C. isolators 11*a* and 1l*b* are positioned at the terminals of the electrolysis circuit 9 for isolating said electrolysis circuit from the power supply means consisting in electric current line 2, transformer 3 and rectifier 5.

The gates of thyristors 6 and 7 of rectifier 5 are connected to a control circuit 12 which generates the firing pulses for the thyristors. The thyristors control circuit 12 receives the triggering sequence of the thyristors from an automatic current controller 13. The automatic current controller 13 is further connected to a synchronism and measurement circuit 16 which provides for sending the synchronism signal of firing the thyristors to controller 13. Circuit 16 derives the synchronizing signal from the primary feed line 2, to which it is connected. In addition, the synchronism and measurement circuit 16 controls the minimum voltage supplied by line 2 in order to cut-out the rectifier 5 in case the primary voltage sinks below a pre-determined level.

Further, controller 13 is connected to the measure and current feed-back circuit 15, the latter receiving an input signal from a current transformer 14 positioned between transformer 3 and rectifier 5. Said circuit 15 senses the current supplied by rectifier 5. The controller 13 is connected to its own power supply 17.

The automatic current controller 13 is further provided with a potentiometer 24 for the control of the current set-point.

The system of the present invention comprises also a selector 22 which allows for starting the short-circuiting operation. The selector 22 sends a start-up signal both to the control circuit 12 and to AND gate 23, the inlet of which is provided also with a signal of zero-current of rectifier 5 from controller 13. The output signal of gate 13 is sent to a command circuit 20. A jumper switch means 18 provided with switch 19 is applied at the terminals of the electrolyzer to be disconnected 10*c*. The switch 19 and the command circuit 20 are connected to a limit switch 21, which senses the exact position of switch 19 and makes control circuit 12 send a firing pulse to the thyristors, depending on the position of switch 19.

The operation of the system of the present invention may be summarized as follows.

During normal operation of the electrolysis plant, a primary three-phase current in the order of 11 kV flows through line 2 at a frequency of 50 Hz. The high voltage switch gear 4 of transformer 3 is obviously closed and the primary voltage is transformed into the output voltage which is sent to the terminals of rectifier 5, that is to the terminals of thyristors 6 and 7. The start-up of thyristors 6 and 7 is controlled by the control circuit 12, which in turn is controlled by the automatic current controller 13.

The controller 13 receives the set point signal through the potentiometer 24 having a positive polarity and a feed-back signal which is a function of the flowing current sensed by transformer 14. It is this difference between the two signals that controls thyristors 6 and 7 through circuits 12 and 13. The control circuit 12 is synchronized by the primary voltage of line 2 by means of synchronism and measurement circuit 16, through controller 13. Therefore, firing of the thyristors 6 and 7 takes place in phase-coincidence with transformer 3.

Further, the signal coming from the synchronism and measurement circuit 16 is used to measure the primary voltage and controlling the minimum voltage and phase sequence on the primary side of the transformer 3. If this voltage either decreases to 80% of the nominal value or has a wrong sequence, the rectifier 5 is cut-out for protection purposes.

In case one of the electrolyzers is to be by-passed, the operator initiates the sequence by turning on selector 22 which sends a start-up signal to the control circuit 12 and to AND gate 23. When this signal is received, the firing pulses sent from control circuit 12 to the thyristors 6 and 7 are stopped.

As the thyristors of rectifier 5 are no more conducting, the current goes to zero. The condition of zero-current is checked by transformer 14 and by measurement and current feed-back circuit 15. The measurement and current feed-back circuit 15 sends a signal of zero current to AND gate 23 through controller 13. This zero-current signal and the start-up signal coming from selector 22 activate AND gate 23 which operates the command circuit 20.

The command circuit 20 provides for closing switch 19 of the jumper switch means 18 connected to the electrolyzer to be excluded. The limit switch 21 senses the position of switch 19 and checks whether jumper switch means 18 is closed. Once said checking is effected, the limit switch sends with a small delay a signal of re-starting of the firing pulses to the thyristors to the control circuit 12.

In this way the supply of electric current to the electrolysis circuit is interrupted only for an extremely limited time, typically in the range of 200–1000 milliseconds, in order not to affect the operation conditions of the electrolysis process. It is evident that the interruption of current depends on the closing time of switch 19.

With a quick switch the interruption time may be extremely reduced. In addition, the signal for re-starting the firing pulses is sent with a small delay in order to avoid any risk that the supply of electric current to the electrolysis circuit 9 be resumed before the closing of the switch 19.

In the same way the jumper switch means 18 may be opened to connect again the serviced electrolyzer to the electrolysis circuit 9. The selector 22 sends a start-up signal to the control circuit 12 and to AND gate 23. The firing pulses to thyristors 6 and 7 are stopped and the condition of zero-current supplied by rectifier 5 is checked by means of circuits 14 and 15. Then, AND gate 23 activates the command circuit 20, which opens switch 19. The limit switch 21 senses whether switch 19 has completed the opening operation and thereafter it sends, preferably with a small predetermined delay, the re-starting signal of the firing pulses to thyristors 6 and 7 to the control circuit 12.

The above description is only intended to illustrate one embodiment of the present invention. The various details can be substituted for technical equivalents. The materials and the shapes or dimensions or the elements will be chosen depending on the specific requirements, without departing from the spirit of the present invention which is only intended to be defined by the following appended claims.

I claim:

1. A short-circuiting system for by-passing at least one electrolyzer (10*c*) in a multiplicity of monopolar or bipolar electrolyzers in an electrolysis circuit comprising power supply means including an electric current line (2), a rectifier (5) based on thyristors (6) and (7) and a transformer (3) for feeding electrolysis current to said electrolyzers and a control system (12) connected to an automatic current controller (13) connected in turn to a synchronism and measurement circuit (16), a jumper switch (18) with a switch (19) for by-passing said electrolyzer (10*c*), characterized in that switch (19) comprises a selector means (22) suitable for sending a start-up signal both to the control circuit (12) and to AND gate (23), connected in turn to said controller (13), a command circuit (20) connected to said gate (23) and to said jumper switch means (18) for the interruption of the electric current supplied to said electrolysis circuit for at least a time sufficient to permit shortcircuiting of said electrolyzer (10*c*) and a limit switch (21) to re-start said electric current, said interruption of electric current not affecting the operating conditions of said multiplicity of monopolar or bipolar electrolyzers.

2. The system of claim 1 wherein the automatic current controller (13) is further connected to a measure and current transformer (14) positioned between transformer (3) and rectifier (5).

3. A method for by-passing at least one electrolyzer (10*c*) in a multiplicity of monopolar or bipolar electrolyzers in an electrolysis circuit by utilizing the short-circuiting system of claim 1, comprising a. turning on selector (22) to reach the zero-current condition, by stopping the firing pulses from control circuit (12) to thyristors (6) and (7) and sending a signal to AND gate (23).

b. controlling the condition of zero-current by transformer (14) and by circuit (15).

c. sending a signal of zero-current to AND gate (23) through controller (13) and a start-up signal sent to command circuit (20).

d. closing switch (19) through command circuit (20) to by-pass the electrolyzer (10*c*).

e. sensing the position of switch (19) by limit switch (21) and f. re-starting with a small delay the firing pulses to thyristors (6) and (7) by limit switch (21).

4. The method of claim 3, characterized in that the small delay is in the range of 200–1000 milliseconds.

* * * * *